US006218621B1

(12) United States Patent
Kuczynski

(10) Patent No.: US 6,218,621 B1
(45) Date of Patent: Apr. 17, 2001

(54) HIGH-FREQUENCY DATA TRANSMISSION CABLE AND METHOD AND APPARATUS FOR FABRICATING IT

(75) Inventor: Christian Kuczynski, Fumay (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 09/088,121

(22) Filed: Jun. 1, 1998

(30) Foreign Application Priority Data

Jun. 2, 1997 (FR) ..... 97 06736

(51) Int. Cl.[7] ..... H01B 7/00

(52) U.S. Cl. ..... 174/110 R; 174/113 R; 174/110 F; 174/116

(58) Field of Search ..... 174/113 R, 110 R, 174/110 P, 110 F, 113 C, 116 R, 36, 117 R

(56) References Cited

U.S. PATENT DOCUMENTS

| | | | | |
|---|---|---|---|---|
| 3,315,025 | * | 4/1967 | Tomlinson | 174/107 |
| 4,204,086 | * | 5/1980 | Suzuki | 174/102 R |
| 4,221,756 | * | 9/1980 | Piper et al. | 264/174 |
| 4,352,701 | * | 10/1982 | Shimba et al. | 156/51 |
| 4,468,435 | * | 8/1984 | Shimba et al. | 428/383 |
| 4,560,829 | * | 12/1985 | Reed et al. | 174/102 R |
| 4,663,098 | * | 5/1987 | Gilliam et al. | 264/104 |
| 4,755,629 | | 7/1988 | Beggs et al. | 174/34 |
| 4,963,222 | * | 10/1990 | Bonjour et al. | 156/393 |
| 5,110,998 | * | 5/1992 | Muschiatti | 174/24 |
| 5,142,100 | * | 8/1992 | Vaupotic | 174/24 |
| 5,283,390 | * | 2/1994 | Hubis et al. | 174/36 |
| 5,313,020 | * | 5/1994 | Sackett | 174/113 |
| 5,486,654 | * | 1/1996 | Hanak et al. | 174/113 R |
| 5,493,071 | * | 2/1996 | Newmoyer | 174/113 R |
| 5,514,837 | * | 5/1996 | Kenny et al. | 174/113 R |
| 5,841,072 | * | 11/1998 | Gagnon | 174/110 F |

FOREIGN PATENT DOCUMENTS 1564336 4/1969 (FR) .

* cited by examiner

*Primary Examiner*—Dean A. Reichard
*Assistant Examiner*—William H Mayo, III
(74) *Attorney, Agent, or Firm*—Sughrue, Mion, Zinn, Macpeak & Seas, PLLC

(57) ABSTRACT

A high-frequency data transmission cable includes a plurality of groups of twisted conductors and a sheath placed around the groups of twisted conductors delimiting an internal volume for housing the groups of twisted conductors. The groups of twisted conductors are placed at the periphery of the internal volume and are practically equidistant from each other. The internal volume contains, in addition to the groups of twisted conductors, a plastics material foam that holds the groups of twisted conductors in position. Applications include data transmission networks.

13 Claims, 1 Drawing Sheet

HIGH-FREQUENCY DATA TRANSMISSION CABLE AND METHOD AND APPARATUS FOR FABRICATING IT

BACKGROUND OF THE INVENTION

1. Field of the Invention

The present invention concerns high-frequency data transmission cables and a method and apparatus for fabricating a cable of this kind.

2. Description of the Prior Art

Because computer and other networks use ever increasing data bit rates, it is necessary to improve the performance of cables. Two parameters in particular are very important in high-frequency data transmission: crosstalk between the pairs of conductors and the regularity of the impedance of these pairs.

Crosstalk between pairs is a phenomenon whereby signals transmitted in one pair generate noise in the adjacent pairs. Other things being equal, crosstalk is reduced by increasing the distance between the pairs. The regularity of the impedance of a pair is determined by a reflection measurement; it can be obtained easily in a twisted pair of the conductors which have an insulation of constant thickness and good concentricity, but is more difficult to obtain in the case of quads, because there is a risk of the conductors being locally at a greater distance from each other.

Although the invention applies essentially to cables having two to eight groups of twisted conductors, each group preferably comprising two or four twisted conductors, it applies to other numbers of conductors. Sheathed electrical cables comprising a plurality of conductors and a core filled with a plastics material foam are known in themselves. For example, U.S. Pat. No. 3,681,510 describes a sheathed electrical cable having a plurality of conductors and the core of which is filled with a plastics material foam. Insulated conductors are uniformly distributed in the core, both at the center and towards the periphery, which is delimited by a material that is also coated with the plastics material foam. In this cable the pairs of conductors are not individualized, and this cable is therefore not suited to high-frequency data transmission.

Japanese patent application JP-52 82 921 describes a cable formed by accommodating a flat cable wound on itself, comprising some ten parallel wires, for example, so that it fits in a circular section sheath, the interior space being filled with polyethylene foam. In cross-section the disposition of the conductors is substantially in the form of a spiral, one edge conductor of the flat cable being placed towards the interior of the circular cable and that at the other edge being in contact with the sheath. A small number of conductors is placed at the outside periphery and all the conductors are adjacent to each other. Crosstalk between pairs is increased relative to that of the flat cable on its own, because the edge conductors are also near the other conductors.

U.S. Pat. No. 4,755,629 discloses a cable for use in local area networks in which twisted pairs are each placed in a sheath. The pairs for transmitting data are surrounded by a shield. Other pairs, on the outside, are intended to transmit voice signals and not data. According to this patent, to reduce crosstalk the twisted pairs are moved apart by incorporating each pair into a circular section sheath, the two sheaths being in contact but holding the pairs apart.

The invention concerns a different construction enabling crosstalk to be reduced by moving the pairs apart and procuring excellent regularity of impedance.

In accordance with the invention, the groups of twisted conductors, which are preferably pairs or quads, are at a maximum distance from each other because they are placed in a member which, during its construction, separates them as far as possible, within the limits of a mold that forms the outside surface of the inside part of the cable. In this way the groups of twisted conductors which are fed in so that they are equidistant at the inside periphery of the mold are separated as far as possible, i.e. pushed against the inside surface of the mold, by the foam insulative internal member that holds them in place. In this way the pairs are as far apart as possible, given the imposed diameter, and this reduces crosstalk. The pairs are positioned by the foam when it has hardened, so that each twisted conductor group retains its regularity of impedance.

SUMMARY OF THE INVENTION

To be more precise, the invention consists in a high-frequency data transmission cable comprising:

- a plurality of groups of twisted conductors, and
- a sheath placed around the groups of twisted conductors, the sheath delimiting an internal volume for housing the groups of twisted conductors, wherein:

- the groups of twisted conductors are placed at the periphery of the internal volume and are practically equidistant from each other, and
- the internal volume contains in addition to the groups of twisted conductors a plastics material foam that holds the groups of twisted conductors in position.

The number of groups of twisted conductors is preferably in the range two to eight inclusive and the number of twisted conductors in a group is preferably equal to two or four.

In one embodiment each group is surrounded by an intermediate sheath, for example, when the number of twisted conductors in the group is equal to four.

It is advantageous for the groups of twisted conductors themselves to be twisted. The pitch of the groups of twisted conductors is greater than 100 mm, for example.

The cable preferably further includes a shield between all the groups of twisted conductors and the sheath. The cable can additionally include a shield around each of the groups of twisted conductors. However, it is preferable if the separate conductors are not shielded.

According to one highly advantageous feature of the invention, the plastics material foam does not adhere to the groups of twisted conductors. The foam can advantageously be of the closed cell type in which the cells contain an inert gas.

In one embodiment the outside surface of the group of twisted conductors is formed of high-density polyethylene and the composition of the plastics material of the foam is based on low density polyethylene.

In one embodiment the plastics material of the foam is charged with a material imparting non-inflammable properties to it, for example metal hydroxides. The plastics material of the foam can also be charged with a conductive material.

The section of the internal volume is generally circular.

However, in one highly advantageous embodiment, the number of groups of twisted conductors is equal to two, the number of twisted conductors in each group is equal to four and the section of the internal volume is elongate.

The invention also consists in a method of fabricating a data transmission cable including a plurality of groups of twisted conductors disposed in a sheath, the method comprising:

preparing an elongate cylindrical mold having a section substantially equal to the inside section of the sheath, introducing a plurality of groups of twisted conductors at equidistant locations at the inside periphery of the mold at a first end of the latter and very near the wall of the mold, feeding a composition based on a plastics material adapted to form a foam into a first end of the mold and practically at the center of the section thereof, the composition and the conditions in the mold being such that the composition, as it expands in the mold to form the foam, pushes the groups of twisted conductors against the inside surface of the mold and, on leaving the mold, forms a member that retains its shape and that holds the groups of twisted conductors apart, and then applying a sheath at least to the member.

It is advantageous for the step of applying a sheath to include the application of a shield to the member and then the application of a sheath over the shield.

It is advantageous for the method to include a step of applying to the inside surface of the mold a material adapted to progress with the member and remain on its surface, for example a ribbon that is wound onto the member.

The method preferably further comprises the preparation of the plastics material composition in the form of a composition containing a dissolved or compressed gas which expands in the mold to form a foam.

The method preferably further comprises relative rotation of the member and of the locations into which the groups of twisted conductors are fed so that the groups of twisted conductors are themselves twisted.

The method preferably prevents the groups of twisted conductors sticking to the plastics material composition of the foam.

The method preferably further comprises the use for the foam of a plastics material different from that at the outside surface of the groups of twisted conductors.

In one embodiment the plastics material composition of the foam is based on a thermoplastics material and the method further comprises cooling the mold so that the foam member has hardened on leaving the mold.

In another embodiment the plastics material composition of the foam is based on a thermosetting material and the method further comprises heating the mold so that the foam member hardens before leaving the mold.

The invention further consists of an apparatus for fabricating a data transmission cable as indicated in the foregoing paragraphs comprising an elongate cylindrical mold, a device for feeding groups of twisted conductors at a first end of the mold and comprising a guide member for the groups of twisted conductors such that they are equidistant from each other at the inside periphery of the mold, a device for feeding a composition based on a plastics material adapted to form a foam disposed at the center of the section of the mold at the first end thereof and a device for extracting the foam member that holds the groups of twisted conductors apart.

The device preferably further includes a device for relatively rotating the foam member and the device for feeding groups of twisted conductors so that the groups of twisted conductors are themselves twisted.

The device for feeding a composition is preferably a device for injecting a foam under pressure containing a dissolved or compressed gas.

It is also advantageous for the apparatus further to include a device for cooling the mold or a device for heating the mold.

In this description "shield" designates a conductive member providing electromagnetic or electrostatic protection and the term "sheath" designates an electrically insulative member also assuring mechanical protection.

Other features and advantages of the invention will become clearer from the following description given with reference to the accompanying drawings.

DETAILED DESCRIPTION OF THE PREFERRED EMBODIMENT

Figure 1:
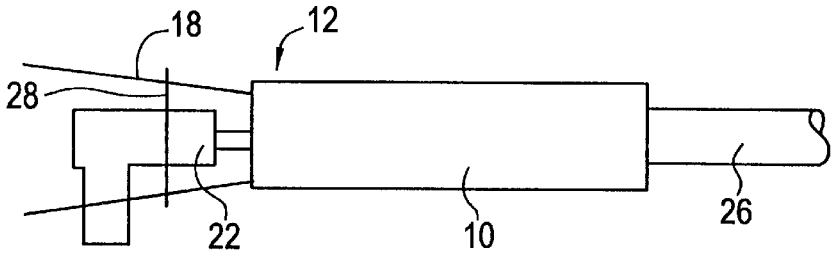
FIG. 1 is a diagrammatic lateral elevation view of the principal components of apparatus for fabricating a cable in accordance with the invention.
Figure 2:
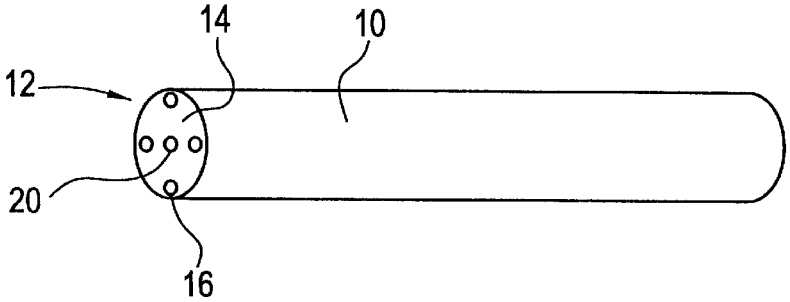
FIG. 2 is a perspective view of the mold used in the apparatus from FIG. 1.
Figure 3:
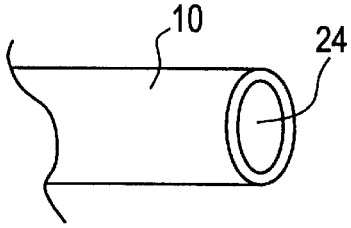
FIG. 3 is a perspective view of one end of the mold used in the apparatus from FIG. 1.

FIG. 1 shows apparatus for fabricating a data transmission cable in accordance with the invention. The main item in this figure is the mold 10. The latter is shown better in FIGS. 2 and 3. FIG. 2 shows that the mold has a generally cylindrical shape with a first end 12 closed by a flange 14 that delimits four peripheral holes 16 through which groups 18 of twisted conductors pass and a central hole 20 adapted to cooperate with an injection device 22.

The other end of the mold 10 has a circular orifice 24 constituting a die for calibrating the central member 26 of the resulting cable. In the example under discussion, the mold has a circular section but this feature is not mandatory.

FIG. 1 shows that the group 18 of twisted conductors, for example pairs or quads, is first fed into a guide plate 28 and then into the holes 16 in the mold. The injection device 22 feeds a composition through the central hole 20 of the mold, preferably a foam containing a dissolved gas or a compressed gas at a high pressure so that the composition forms a foam in the mold 10. The combination of the foam and the groups 18 of twisted conductors it contains is extracted from the other end of the mold via the calibration die.

The properties and the functions of the mold obviously differ according to the composition used. Its essential feature is that, inside the mold, the composition fed in can first form the foam and then harden and exit the mold via the calibration die with a particular dimension.

In one example the plastics material composition that forms the foam is based on low-density polyethylene containing compressed nitrogen and is fed in at a temperature in the usual range for injecting the particular low-density polyethylene selected and the part of the mold near the calibration die cools the foam sufficiently for it to have hardened on leaving the mold.

In another example the material is a thermosetting plastics material foam containing a pore-generating material and the part of the mold near where the groups of twisted conductors are fed in is heated so that the reaction forming the foam and polymerizing the plastics material takes place. The part near the calibration die can advantageously be cooled.

Although two examples have been given, any plastics material foam having the following two essential properties can be used. Firstly, the dissipation factor at high frequencies, represented by the tangent of the loss angle, must be sufficiently low, preferably in the order of 0.004 at 100 MHz. This is not an absolute limit in that a material yielding a value corresponding to 0.008 may also be suitable, for example. However, it is important to choose a composition giving a low dissipation factor in this order.

Secondly, the plastics material of the foam used must not adhere to the groups of twisted conductors. The plastics material composition of the foam must therefore be chosen to suit the composition of the insulation forming the outside layer of the groups of twisted conductors, or conversely the material forming the outside layer of the groups of twisted conductors must be chosen to suit the plastics material foam composition used to form the foam.

In the first example mentioned above, in which the foam is formed from low-density polyethylene, groups of twisted conductors can be used whose outside surface is formed of high-density polyethylene, because these two materials adhere only slightly under the applicable conditions.

The expression "material of the outside surface of the groups of twisted conductors" designates either the outside surface of each conductor of a pair or of a quad if the pair or the quad is fed into the mold as such or the surface of sheath placed around the pair or the quad, preferably around the quad. It has been found (French patent FR-2 698 477) that disposing a sheath around a quad increases the regularity of impedance. The quads used to form some types of cable in accordance with the invention can therefore include a sheath of this kind. In this case the plastics material composition of the foam must not adhere to the material of this sheath.

During fabrication of the cable in accordance with the invention it is advantageous for there to be relative rotation between the holes through which the groups of twisted conductors pass (and the plate guiding them towards these holes), on the one hand, and the central member containing the foam and the groups of twisted conductors at the exit from the mold, on the other hand, so that the groups of twisted conductors are themselves twisted in the central member, for example with a pitch of at least 100 mm and preferably a few tens of centimeters.

Of course, the plastics material composition of the foam advantageously has a number of properties already known in themselves for manufacturing electrical cable elements. For example, for it to have non-inflammable properties it is desirable for the composition to contain a charge of metal hydroxides. A charge of this kind also enables the foam to shrink on itself and plug spaces in the event of excessive heating, which prevents the formation of elongate passages in the cable which can constitute air passages feeding a fire. For this reason it is also advantageous for the foam to be of the closed cell type, rather than the open cell type, although this feature is not absolutely indispensable. With the same aim in view, it is also advantageous for the internal gas of the foam not to encourage combustion, for example for it to be nitrogen.

In some applications it is advantageous for the foam member to have certain conductive properties. It is therefore possible to incorporate into the injected mixture a metal powder or a material conferring conductive properties. However, this is merely one possible feature of the invention.

Figure 4:
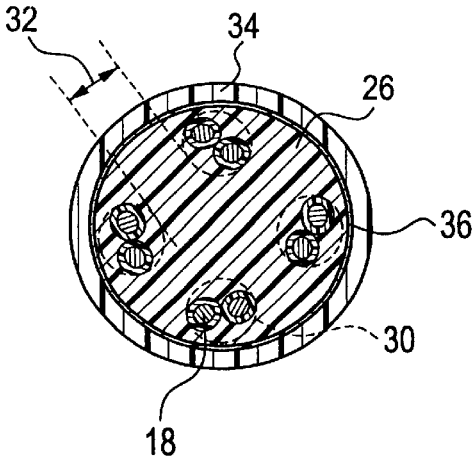
FIG. 4 is a sectional view of one example of a data transmission cable in accordance with the invention.

FIG. 4 shows the cross-section of a data transmission cable in accordance with the invention, the central member 26 of which is made using the apparatus from FIG. 1.

The chain-dotted circles 30 which represent cylinders circumscribed around each twisted pair 18 are tangential or practically tangential to the outside surface of the foam central member 26, so that the twisted pairs 18 are at the maximum distance from each other, as indicated by the spaces 32 separating the chain-dotted circles 30. Note, however, that the plastics material foam penetrates these circumscribed cylinders, in contact with all of the twisted pairs. Given that the foam expands in the mold from the center towards the outside, the foam may not completely fill small voids between the outside periphery and a conductor or between two twisted conductors, but these very localized filling defects do not in practice have any effect on the properties of the cable.

At the exterior of the central member containing the twisted pairs the cable comprises an outer sheath 34 and advantageously a conductive shield 36. The conductive shield 36 is not indispensable, depending on the thickness of the sheath 34 and the intended application.

Cables of the type shown in FIG. 4 can comprise groups of twisted conductors other than pairs. The number of twisted conductors of each group can be equal to two or four, for example. Each group can include a sheath.

The number of groups of twisted conductors can vary and is preferably in the range two to eight.

In installations implemented with such cables, cables are generally grouped together, sometimes as many as 15 to 20. Three such cables are connected to a user in a building, for example. The cables can be placed side by side in conventional cable ducts.

Compared to a cable of similar size in which this maximal separation of the pairs is not achieved, crosstalk can be improved by around 10 dB, for example to 48 dB rather than 38 dB, as usually obtained with good cables of conventional construction (measured at 100 MHz).

The regularity of impedance is improved in that it varies only in the range 5 W to 6 W, while conventional cables show a variation in the order or 8 W to 10 W.

Given the dissipation factor at high frequencies (tangent of the loss angle, preferably less than 0.01 at 100 MHz and advantageously in the order of 0.004), the choice of the plastics material constituting the central member is limited. Examples are the family of polyolefins (such as polyethylene and polypropylene) and fluorinated materials, in particular fluorinated ethylene polymers.

The essential features of a cable in accordance with the invention are therefore the fact that the groups of twisted conductors are as far apart as possible, the fact that the material of the foam does not adhere to the material of the groups of twisted conductors and the fact that the material of the foam has a low dissipation factor.

The advantages obtained are reduced crosstalk, improved regularity of impedance and the possibility of producing optimized cables. For example, it is possible to move the shield farther away and therefore to use insulated wires of small diameter. This feature facilitates connection and in particular enables rationalization of the diameter of the insulation. Further, it is possible to adjust the characteristic impedance of a pair of the cable by modifying the thickness of the foam member. It is thus possible to make cables with different impedances using the same components. Moreover, laying and connecting the cables are facilitated by the fact that the foam can easily be peeled away from the groups of twisted conductors. Consequently connection times can be minimized.

Obviously the invention has been described by way of preferred example only and any technical equivalents of its component parts can be used without departing from the scope of the invention.

What is claimed is:

1. A high-frequency data transmission cable comprising:

a plurality of groups of twisted conductors, and a plastic outer sheath containing said groups of twisted conductors, said sheath delimiting an internal volume for housing said groups of twisted conductors in a spaced apart relationship with each other, and a plastics material foam which fills said internal volume of said sheath, said plastics material foam which holds said groups of twisted conductors as far apart as possible, said groups of twisted conductors being placed at a periphery of said internal volume and being substantially equidistant from each other.

2. The cable claimed in claim 1 wherein said plastics material foam does not adhere to said groups of twisted conductors and is relatively easily peeled away from said conductors.

3. The cable as claimed in claim 1 further including a shield disposed around said groups of twisted conductors and under said sheath.

4. The cable claimed in claim 1 wherein there are two groups of twisted conductors, there are four twisted conductors in each group and said internal volume has an elongate section.

5. The cable claimed in claim 1 wherein said groups of twisted conductors are themselves twisted.

6. An apparatus for fabricating a data transmission cable as claimed in any one of claims 1 to 5 comprising:

an elongate cylindrical mold having an inside periphery a device for feeding groups of twisted conductors at a first end of said mold and comprising a guide member for said groups of twisted conductors such that said groups of twisted conductors are equidistant from each other at the inside periphery of said mold, a device for feeding a composition based on a plastics material adapted to form a foam disposed at a center of a cross section of said mold at a first end thereof, and a device for extracting the foam member that holds said groups of twisted conductors apart.

7. The apparatus as claimed in claim 6 further including a device for relatively rotating said foam member and said device for feeding groups of twisted conductors so that said groups of twisted conductors are themselves twisted.

8. The apparatus claimed in claim 6 wherein said device for introducing a composition is a device for injecting a foam under pressure containing one of a dissolved and compressed gas.

9. A high-frequency data transmission cable comprising:

a plurality of groups of twisted conductors, and a sheath placed around said groups of twisted conductors, said sheath delimiting an internal volume for housing said groups of twisted conductors, wherein said groups of twisted conductors are placed at the periphery of said internal volume and are substantially equidistant from each other, and said internal volume contains in addition to said groups of twisted conductors, a plastics material foam that fills said volume and holds said groups of twisted conductors in position, said plastics material foam being conductive.

10. A high-frequency data transmission cable comprising:

a plurality of groups of twisted conductors;

a sheath placed around said groups of twisted conductors, said sheath delimiting an internal volume for housing said groups of twisted conductors; and a plastics material foam which fills said internal volume of said sheath, said plastics material foam which holds said groups of twisted conductors as far apart as possible, said groups of twisted conductors being placed at a periphery of said internal volume and being substantially equidistant from each other;

wherein said plastics material foam does not adhere to said groups of twisted conductors and is relatively easily peeled away from said conductors.

11. A method of fabricating a data transmission cable including a plurality of groups of twisted conductors disposed in a sheath having an inside diameter, said method comprising:

preparing an elongate cylindrical mold having an inside wall with an inside periphery and an inside peripheral surface, with a diameter substantially equal to the inside diameter of said sheath, introducing a plurality of groups of twisted conductors at equidistant locations at the inside periphery of said mold at a first end of the mold and proximate to the wall of the mold, feeding a composition based on a plastics material adapted to form a foam into a first end of said mold and substantially at a center of the inside diameter thereof, said composition and conditions in said mold being such that said composition, as it expands in said mold to form said foam, pushes said groups of twisted conductors against said inside peripheral surface of said mold, and on leaving said mold, forms a member that retains its shape and that holds said groups of twisted conductors apart, and then applying a sheath at least to said member.

12. The method as claimed in claim 11 further including a relative rotation of said member and locations into which said groups of twisted conductors are introduced so that said groups of twisted conductors are themselves twisted.

13. The method as claimed in claim 11 wherein said groups of twisted conductors are prevented from sticking to said plastics material composition of said foam by using for said foam a plastics material different from that of said outside surface of said groups of twisted conductors.

* * * * *